US008148960B2

(12) United States Patent
Tonomura

(10) Patent No.: US 8,148,960 B2
(45) Date of Patent: Apr. 3, 2012

(54) VOLTAGE REGULATOR CIRCUIT

(75) Inventor: Fumio Tonomura, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 171 days.

(21) Appl. No.: 12/662,371

(22) Filed: Apr. 13, 2010

(65) Prior Publication Data

US 2010/0264896 A1 Oct. 21, 2010

(30) Foreign Application Priority Data

Apr. 21, 2009 (JP) ..... 2009-102964

(51) Int. Cl.
*G05F 1/00* (2006.01)

(52) U.S. Cl. ..... 323/273; 323/274; 330/255; 330/260; 361/18

(58) Field of Classification Search ..... 323/271, 323/273, 274, 275, 314; 361/18, 88, 90, 361/91.1, 91.2, 92; 330/255, 259, 260, 265, 330/271

See application file for complete search history.

(56) References Cited

U.S. PATENT DOCUMENTS 5,373,227 A * 12/1994 Keeth ..... 323/313
5,773,967 A * 6/1998 Tenten ..... 323/313
6,265,856 B1 * 7/2001 Cali' et al. ..... 323/273
2008/0303492 A1 * 12/2008 Aiura et al. ..... 323/270

FOREIGN PATENT DOCUMENTS

JP 2005-44203 2/2005

* cited by examiner

*Primary Examiner* — Adolf Berhane
*Assistant Examiner* — Nguyen Tran
(74) *Attorney, Agent, or Firm* — McGinn IP Law Group, PLLC

(57) ABSTRACT

It is desired for semiconductor devices to reduce an inrush current and an overshoot. According to the voltage regulator circuit of the present invention, when a power supply is turned on, a switch SW1 is turned on in response to a control signal CTR1, a switch SW2 is turned off, and a reference voltage Vref is input to the first (+IN) and second (−IN) inputs of a differential amplifier AMP1 as a common voltage. When a common voltage is supplied to the first (+IN) and second (−IN) inputs, the current I flows into a smoothing capacitor C1 from the high-voltage power supply (VDD) via the differential amplifier AMP1 is regulated to be small. Namely, an inrush current can be reduced. Further, according to the voltage regulator circuit 30 of the present invention, the increase of the output voltage Vout from the differential amplifier AMP1 is relaxed so that the overshoot can be suppressed.

10 Claims, 8 Drawing Sheets

VOLTAGE REGULATOR CIRCUIT

INCORPORATION BY REFERENCE

This application is related to Japanese Patent Application No. 2009-102964 filed at 21 Apr. 2009. The disclosure of that application is incorporated herein by reference.

BACKGROUND OF THE INVENTION

1. Field of the Invention

The present invention relates to a voltage regulator circuit applied to an IC for driving a liquid crystal panel used in a mobile telephone, a digital camera or the like.

2. Description of Related Art

A liquid crystal panel driving IC used in a mobile telephone, a digital camera or the like is increasingly made faster in transmission of data (as high-speed serial transmission) and smaller in size. Due to this, the liquid crystal panel driving IC is often designed by a fine and low voltage process (hereinafter, referred to as "the low voltage process") capable of using higher-speed and smaller-sized elements. In such a low voltage process, a voltage with which an element is broken down (withstand voltage of the element) necessarily falls. It is, therefore, required to pay attention to the range of a voltage to be used.

Furthermore, a power supply voltage (battery voltage) supplied from a power supply (battery) to the liquid crystal panel driving IC is often higher than the voltage used in such a low voltage process. Due to this, it is required to use the power supply voltage after regulating the voltage to an appropriate voltage using a voltage regulator circuit included in the liquid crystal panel driving IC.

Moreover, in a normal case, the power supply voltage is stabilized by a device (such as a stabilization circuit) arranged between the power supply and the liquid crystal panel driving IC, and is supplied to the liquid crystal panel driving IC as a supply voltage as a supply voltage. However, not only an average consumption current but also an instantaneous consumption current is desired to be as low as possible for the liquid crystal panel driving IC since the stabilization circuit includes such a function a's a function to prevent overcurrent.

FIG. 1 shows a configuration of a general voltage regulator circuit 110 (hereinafter, referred to as "the voltage regulator circuit 110"). The voltage regulator circuit 110 includes a differential amplifier circuit AMP1, a first resistor element R1 (hereinafter, "the resistor element R1"), and a second resistor element R2 (hereinafter, "the resistor element R2").

The differential amplifier circuit AMP1 is connected to a high-voltage power supply [VDD] supplying a high voltage VDD and a low-voltage power supply [VSS] supplying a low-voltage VSS (ground voltage GND) lower than the high-voltage VDD, and operates with the voltage between the high-voltage VDD and the low-voltage VSS. The differential amplifier circuit AMP1 includes a positive-side input terminal +IN that is a first input terminal, a negative-side input terminal −IN that is a second input terminal, and an output terminal. A reference voltage Vref is supplied to the positive-input terminal +IN as the supply voltage.

One end of the resistor element R1 is connected to the output terminal of the differential amplifier circuit AMP1. One end of the resistor element R2 is connected to the other end of the resistor element R1, and the other end of the resistor element R2 is connected to the low-voltage power supply [VSS]. One end of the resistor element R2 is also connected to the negative-side input terminal −IN via a signal line. One end of a smoothing capacitor C1 is connected to the output terminal of the differential amplifier circuit AMP1 and one end of the resistor element R1 via an output node, and the other end of the smoothing capacitor C1 is connected to the low-voltage power supply [VSS].

The resistor elements R1 and R2 divide an output voltage Vout100 output from the differential amplifier circuit AMP1 into voltages to generate a divided voltage Vmon100 on one end of the resistor element R2. The differential amplifier circuit AMP1 amplifies the difference between the reference voltage Vref supplied to the positive-side input terminal +IN and the divided voltage Vmon100 supplied to the negative-side input terminal −IN. The smoothing capacitor C1 smoothes the output voltage Vout100 output from the differential amplifier circuit AMP1.

FIG. 2 shows a configuration of the differential amplifier circuit AMP1. The differential amplifier circuit AMP1 includes first and second N channel MOS (Metal Oxide Semiconductor) transistors MN1 and MN2 (hereinafter, referred to as "the transistors MN1 and MN2"), first to third P channel MOS transistors MP1, MP2, and MP3 (hereinafter, referred to as "the transistors MP1, MP2, and MP3"), and first and second constant current sources.

Sources of the transistors MN1 and MN2 are connected to one node in common. Gates of the transistors MN1 and MN2 are used as the negative-side input terminal −IN and the positive-side input terminal +IN of the differential amplifier circuit AMP, respectively.

A first constant current source is provided between the sources of the transistors MN1 and MN2 and the low-voltage power supply [VSS]. For example, the first constant current source is a third N channel MOS transistor MN3 (hereinafter, referred to as "the transistor MN3"). The sources of the transistors MN1 and MN2 are connected to the drain of the transistor MN3, and the low-voltage power supply [VSS] is connected to the source thereof. A bias voltage Vbias is supplied to the gate of the transistor MN3 for turning on the transistor MN3.

Sources of the transistors MP1 and MP2 are connected to the high-voltage power supply [VDD] in common, gates thereof are connected to one node in common, and drains thereof are connected to drains of the transistors MN1 and MN2, respectively. The gate of the transistor MP1 is connected to the drain of the transistor MN1.

The source of the transistor MP3 is connected to the high-voltage power supply [VDD], the gate thereof is connected to the drain of the transistor MN2, and the drain thereof is connected to one end of the resistor element R1.

A second constant current source is provided between the drain of the transistor MP3 and the low-voltage power supply [VSS]. For example, the second constant current source is a fourth N channel MOS transistor MN4 (hereinafter, referred to as "the transistor MN4"). The drain of the transistor MP3 is connected to the drain of the transistor MN4 and the low-voltage power supply [VSS] is connected to the source thereof. The bias voltage Vbias is supplied to the gate of the transistor MN4 for turning on the transistor MN4.

Next, operation performed by the voltage regulator circuit 110 will be described below.

The reference voltage Vref is supplied to the positive-side input terminal +IN of the differential amplifier circuit AMP1, and the divided voltage Vmon100 is supplied to the negative-side input terminal −IN of the differential amplifier circuit AMP1. Due to this, the differential amplifier circuit AMP1 operates so that the voltage supplied to the negative-side input terminal −IN is equal to that supplied to the positive-side input terminal +IN, that is, equal to the reference voltage Vref.

If Vref>Vmon100 (namely, if the output voltage Vout100 is lower than a voltage-of-interest), then an ON-resistance of the transistor MP3 falls, and a current I100 falls in the smoothing capacitor C1 via the differential amplifier circuit AMP1 from the high-voltage power supply [VDD]. As a result, the output voltage Vout100 rises. If Vref<Vmon100 (if the output voltage Vout100 is higher than the voltage-of-interest), then the ON-resistance of the transistor MP3 rises, and a current Isink flows in the transistor MN4 included in the differential amplifier circuit AMP1 from the smoothing capacitor C1. As a result, the output voltage Vout falls. By repeating this operation, the output voltage Vout100 is made constant to the voltage-of-interest. In this case, the output voltage Vout100=voltage-of-interest is represented by the following Equation.

$$Vout=Vref\times(R1+R2)/R2$$

SUMMARY OF THE INVENTION

As stated above, the power supply voltage is often higher than the voltage that can be used in a low voltage process. Due to this, the stabilization circuit stabilizes the power supply voltage and supplies the stabilized power supply voltage to the liquid crystal panel driving IC as the supply voltage. This stabilization circuit includes an overcurrent prevention circuit for preventing an overcurrent. The voltage regulator circuit 100 included in the liquid crystal driving IC regulates the supply voltage from the stabilization circuit to an appropriate voltage and supplies the regulated supply voltage to the low voltage logic circuit as the output voltage Vout. Operation performed by the voltage regulator circuit 110 when the liquid crystal panel driving IC is turned on in such a case will be considered.

Normally, a power supply starting sequence is applied to the liquid crystal panel driving IC.

When the liquid crystal panel driving IC is not turned on, then the low-voltage power supply [VSS] is connected to an output of the differential amplifier circuit AMP1, that is, to the output node, and the low-voltage power supply voltage VSS (the ground voltage GND) is supplied to the differential amplifier circuit AMP1 from the low-voltage power supply [VSS]. When the liquid crystal panel driving IC is turned on, then the high-voltage power supply voltage VDD and the reference voltage Vref are generated, and the output of the differential amplifier circuit AMP1 is disconnected from the low-voltage power supply [VSS]. That is, the voltage regulator circuit 110 starts.

First, the output voltage Vout100 is 0 [V] and charge of the smoothing capacitor C1 is zero at the moment the voltage regulator circuit 110 starts. In this case, the reference voltage Vref and the divided voltage Vmon100 satisfy Vref>Vmon100. A gate voltage Vg of the transistor MP3 is near 0 [V] to turn the transistor MP3 almost into the ON-state. Due to this, the ON-resistance of the transistor MP3 is very low. It is to be noted that a transistor having a large gate width is normally used as the transistor MP3 so as to ensure capability at normal time. Next, to charge the smoothing capacitor C1, the current I100 flows in the smoothing capacitor C1 via the differential amplifier AMP1 from the high-voltage power supply [VDD]. However, the current I100 becomes very high as the inrush current since the ON-resistance of the transistor MP3 is very low. The current I100 at this time is referred to as "the inrush current". If the inrush current is high, such a problem possibly occurs that the overcurrent prevention circuit of the stabilizing circuit operates.

Furthermore, the output voltage Vout100 rapidly rises and exceeds the voltage-of-interest. The voltage which excesses the voltage-of-interest in the output voltage Vout100 causes the current Isink to flow into the transistor MN4 included in the differential amplifier circuit AMP1 from the smoothing capacitor C1. As a result, the output voltage Vout100 is to fall down to the voltage-of-interest. However, the current Isink is normally low and it takes time for the output voltage Vout100 to be equal to the voltage-of-interest, resulting in occurrence of overshoot. If overshoot occurs, then a voltage of the low voltage logic circuit that uses the output of the voltage regulator circuit main body 110 as a power supply exceeds a process withstand voltage of an element, possibly causing such a defect as breakdown of the element.

FIG. 5 is a timing chart showing this state. The moment the voltage regulator circuit 110 starts (Power ON), the inrush current increases and overshoot occurs. Therefore, it is desired to reduce the inrush current and the overshoot.

A circuit described in Japanese Patent Publication JP2005-044203A will be described below.

FIG. 3 shows a configuration of a circuit (hereinafter, referred to as "the voltage regulator circuit 210") described in the JP2005-044203A. The voltage regulator circuit 210 includes a differential amplifier circuit AMP200 in place of the differential amplifier circuit AMP1 of the voltage regulator circuit 110.

FIG. 4 shows a configuration of the differential amplifier circuit AMP200. The differential amplifier circuit AMP200 further includes a P channel MOS transistor MP200 and a switch SW200. The source of the transistor MP200 is connected to the high-voltage power supply [VDD], the gate thereof is connected to the drain of the transistor MN2, and the drain thereof is connected to one end of the resistor element R1. The transistor MP200 is relatively small in a gate width so as to increase an ON-resistance of the transistor MP200.

One end of the switch SW200 is connected to the drain of the transistor MN2. The gate of the transistor MP3 is connected to the other end of the switch SW200 in place of the drain of the transistor MN2. A power-ON signal Pon200 is supplied to the switch SW200. A signal level of the signal Pon200 is High if the liquid crystal panel driving IC is turned on. At normal time, the signal level of the signal Pon200 is Low.

The switch SW200 is turned off according to the power-ON signal Pon200 (High), and otherwise turned on. That is, if the liquid crystal panel driving IC is turned on, then the switch SW200 is turned off, the transistor MP3 is not used but the transistor MP200 is used. At the normal time, the switch SW200 is turned on and the transistor MP3 is used.

However, in this case, similarly to the previous case, a gate voltage Vg of the transistor MP200 is almost 0 [V] right and the transistor MP200 is turned into an almost complete ON-state right after the liquid crystal panel driving IC is turned on. Due to this, it is difficult to sufficiently increase the ON-resistance.

According to an aspect of the present invention, a voltage regulator circuit includes: a differential amplifier circuit, a reference voltage is supplied to a first input of the differential amplifier circuit, and a smoothing capacitor is connected to an output of the differential amplifier circuit; a first resistor element whose one end is connected to the output of the differential amplifier circuit; a second resistor element whose one end is connected to another end of the first resistor element; a first switch, one end of the first switch is connected to the first input of the differential amplifier circuit, another end of the first switch is connected to a second input of the differential amplifier circuit, and the first switch is configured to be turned on in response to a first control signal; a second switch, an end of the second switch is connected to the second input of the differential amplifier circuit, another end of the second switch is connected to the second resistor element, and the second switch is turned on in response to a second control signal; and a switch control circuit configured to output the first control signal in a predetermined period from a power supply is turned on, and to output the second control signal after the predetermined period.

In the voltage regulator circuit according to an aspect of the present invention, if the voltage regulator circuit is turned on, then the switch is turned on according to the first control signal, the second switch is turned off, and the reference voltage is supplied, as a same voltage, to the first input and the second input of the differential amplifier circuit. If the voltage supplied to the first input of the differential amplifier circuit is equal to that supplied to the second input terminal thereof, a current value of the current flowing from the high-voltage power supply to the smoothing capacitor via the differential amplifier circuit is limited to low. That is, the inrush current can be reduced. Furthermore, the voltage regulator circuit according to the aspect of the present invention can reduce the overshoot because of gradual rise of the output voltage output from the differential amplifier circuit.

BRIEF DESCRIPTION OF THE DRAWINGS

The above and other objects, advantages and features of the present invention will be more apparent from the following description of certain preferred exemplary embodiments taken in conjunction with the accompanying drawings, in which.

DESCRIPTION OF THE PREFERRED EMBODIMENTS

Hereinafter, some embodiments of the present invention will be described below with reference to the attached drawings.

[Configuration]

Figure 6:
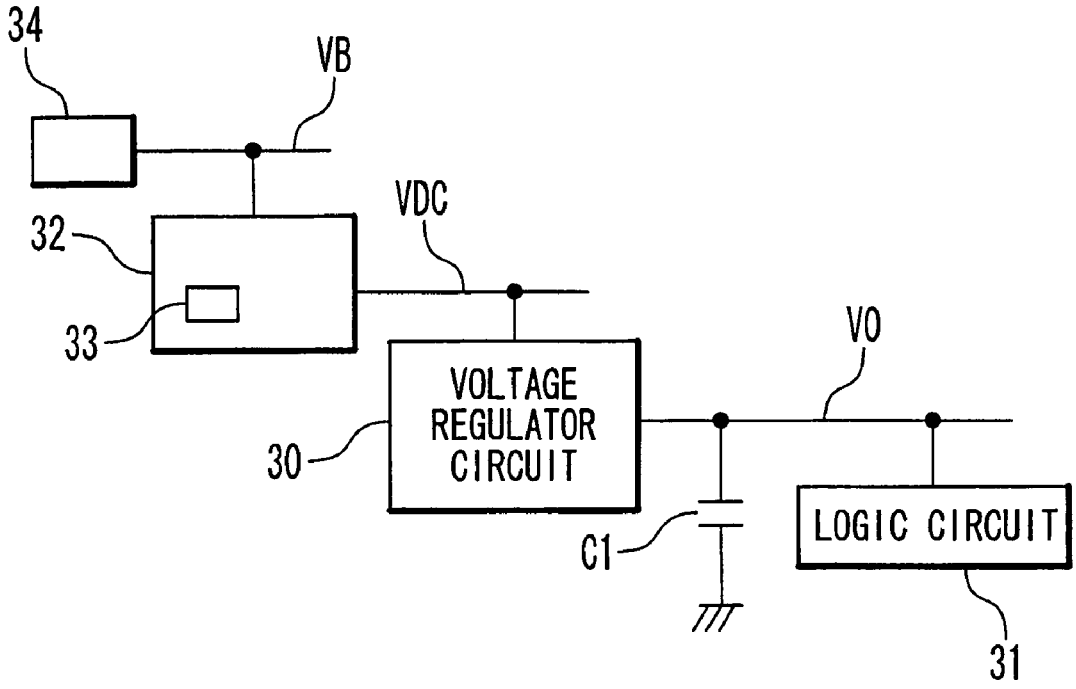
FIG. 6 is a schematic diagram showing a configuration of a device using a voltage regulator circuit 30 according to an embodiment of the present invention.

FIG. 6 shows a configuration of a device using a voltage regulator circuit 30 according to an embodiment of the present invention. The device is used in a mobile telephone, a digital camera or the like, and includes a power supply section 34, a stabilization circuit 32, and a liquid crystal panel driving IC. The liquid crystal panel driving IC includes the voltage regulator circuit 30 according to this embodiment of the present invention (also referred to as "voltage regulator circuit 30"), a low voltage logic circuit 31, and a smoothing capacitor C1.

An output of the power supply section 34 is connected to an input of the stabilization circuit 32. An output of the stabilization circuit 32 is connected to an input of the voltage regulator circuit 30. One end of the smoothing capacitor C1 is connected to an output of the voltage regulator circuit 30, and the other end of the smoothing capacitor C1 is grounded. The low voltage logic circuit 31 is connected to the output of the voltage regulator circuit 30.

The low voltage logic circuit 31 operates with voltage-of-interest VO that is a first voltage.

When a user performs an instruction to turn on the device, the power supply section 34 (battery) supplies a power supply voltage VB (battery voltage) that is a second voltage to the stabilization circuit 32. The power supply voltage VB is higher than the voltage-of-interest VO.

The stabilization circuit 32 stabilizes the power supply voltage VB to a supply voltage VDC and supplies the supply voltage VDC to the liquid crystal display panel driving IC. The stabilization circuit 32 includes an overcurrent prevention circuit 33 for preventing overcurrent.

The supply voltage VDC from the stabilization circuit 32 is input to the voltage regulator circuit 30 included in the liquid crystal panel driving IC as a reference voltage to be described later. The voltage regulator circuit 30 regulates the reference voltage to an appropriate voltage (voltage-of-interest VO) and supplies the appropriate voltage to the low voltage logic circuit 31 as an output voltage to be described later.

Figure 7:
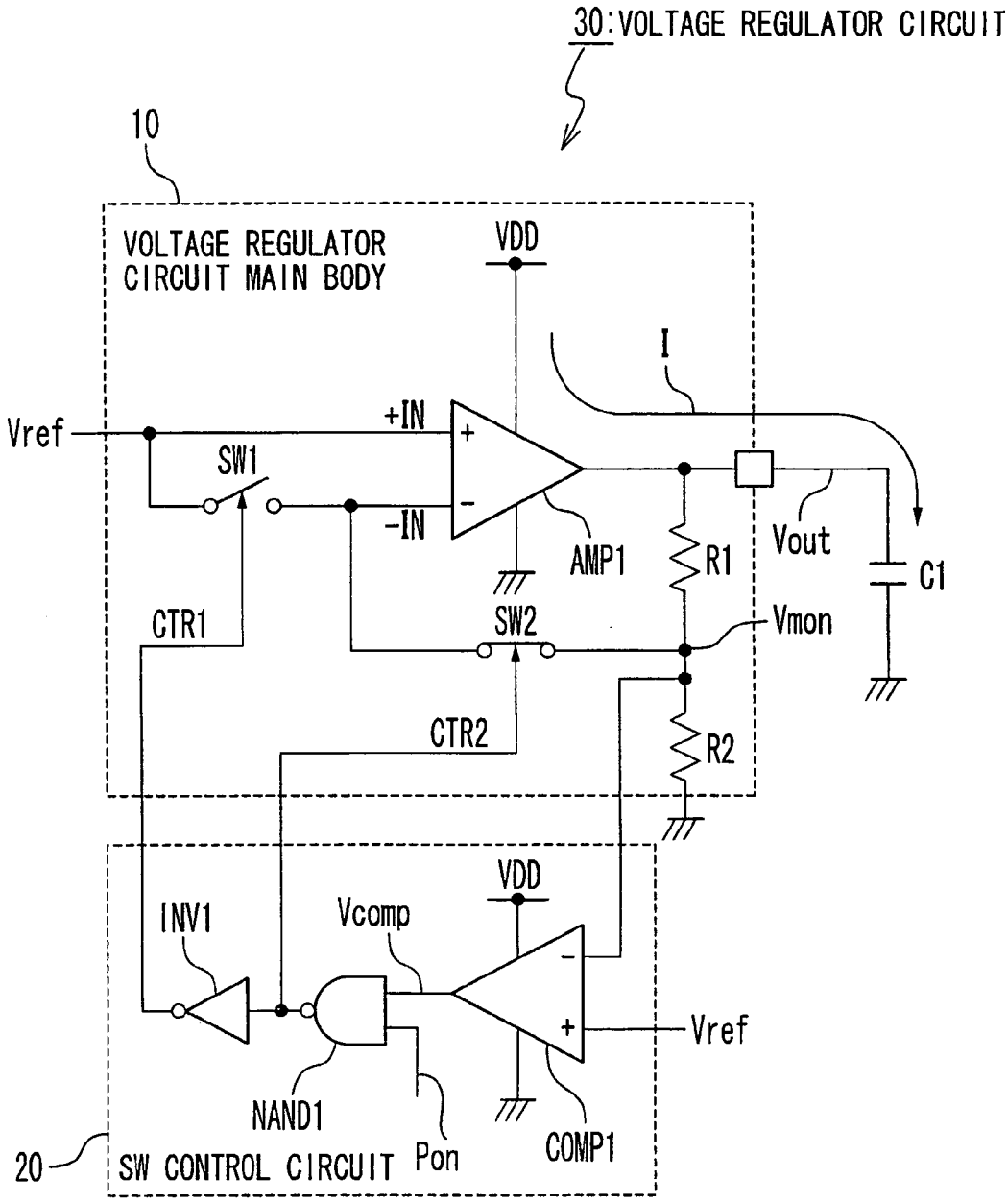
FIG. 7 is a schematic diagram showing a configuration of the voltage regulator circuit 30 according to an embodiment of the present invention.

FIG. 7 shows a configuration of the voltage regulator circuit 30 according to this embodiment of the present invention. It is to be noted that the same constituent elements as those of the voltage regulator circuit 110 (see FIGS. 1 and 2) are denoted by the same reference numerals, respectively.

The voltage regulator circuit 30 includes a voltage regulator circuit main body 10. The voltage regulator circuit main body 10 includes a differential amplifier circuit AMP1, a first resistor element R1 (hereinafter, referred to as "the resistor element R1"), and a second resistor element R2 (hereinafter, referred to as "the resistor element R2").

The differential amplifier circuit AMP1 is connected to a high-voltage power supply [VDD] supplying a high-voltage power supply voltage VDD and a low-voltage power supply [VSS] supplying a low-voltage power supply voltage VSS (ground voltage GND) lower than the high-voltage power supply voltage VDD. The differential amplifier circuit AMP1 operates with a voltage between the high-voltage power supply voltage VDD and the low-voltage power supply voltage VSS. The differential amplifier circuit AMP1 includes a positive-side input terminal +IN that is a first input terminal, a negative-side input terminal −IN that is a second input terminal, and an output terminal. The reference voltage Vref serving as the supply voltage VDC is supplied to the positive-side input terminal +IN.

Figure 1:
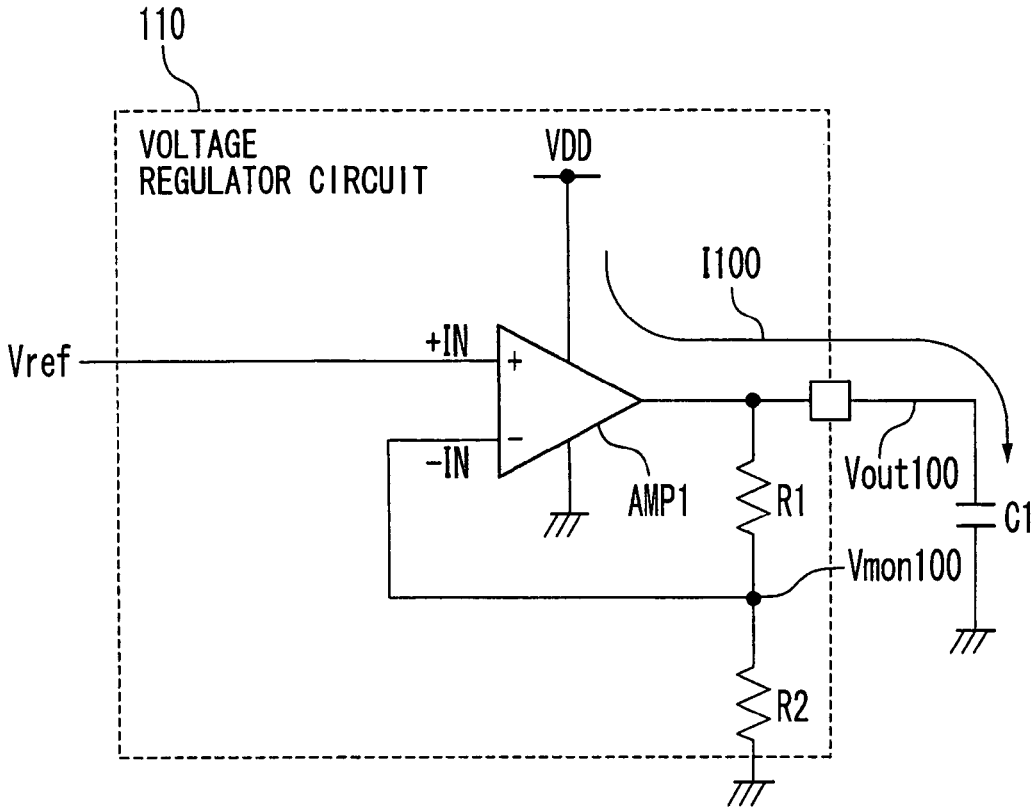
FIG. 1 is a schematic diagram showing a configuration of a general voltage regulator circuit 110 (voltage regulator circuit 110)
Figure 2:
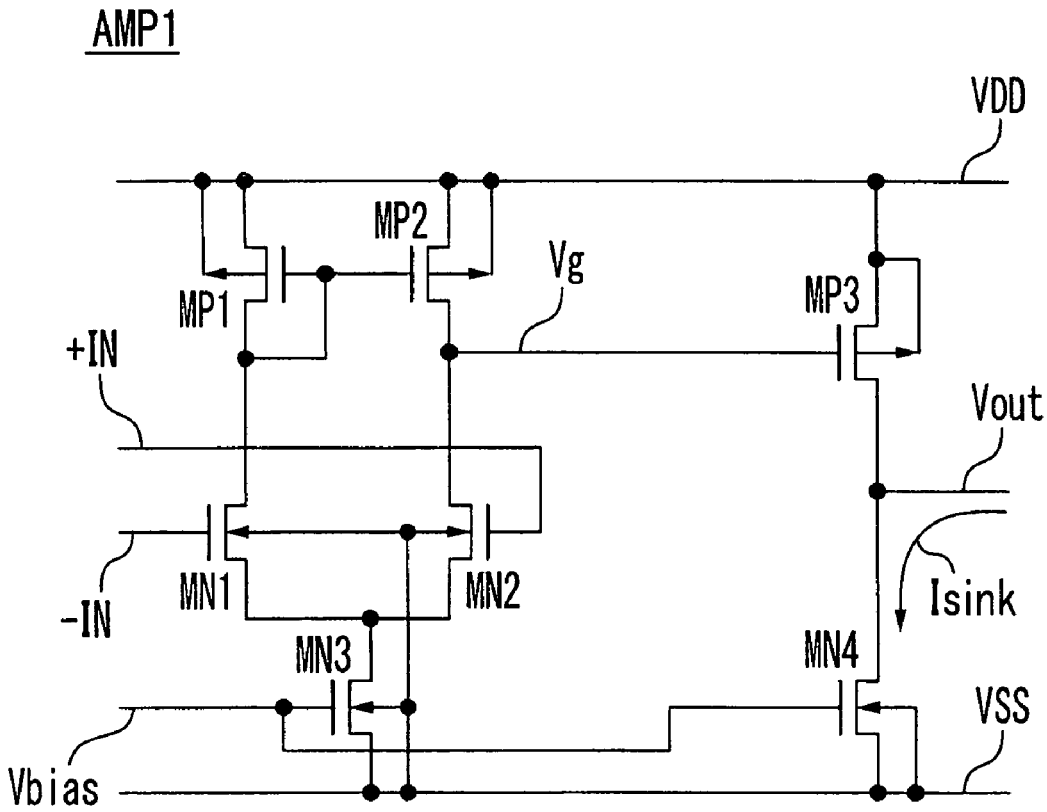
FIG. 2 is a schematic diagram showing a configuration of a differential amplifier circuit AMP1.
Figure 3:
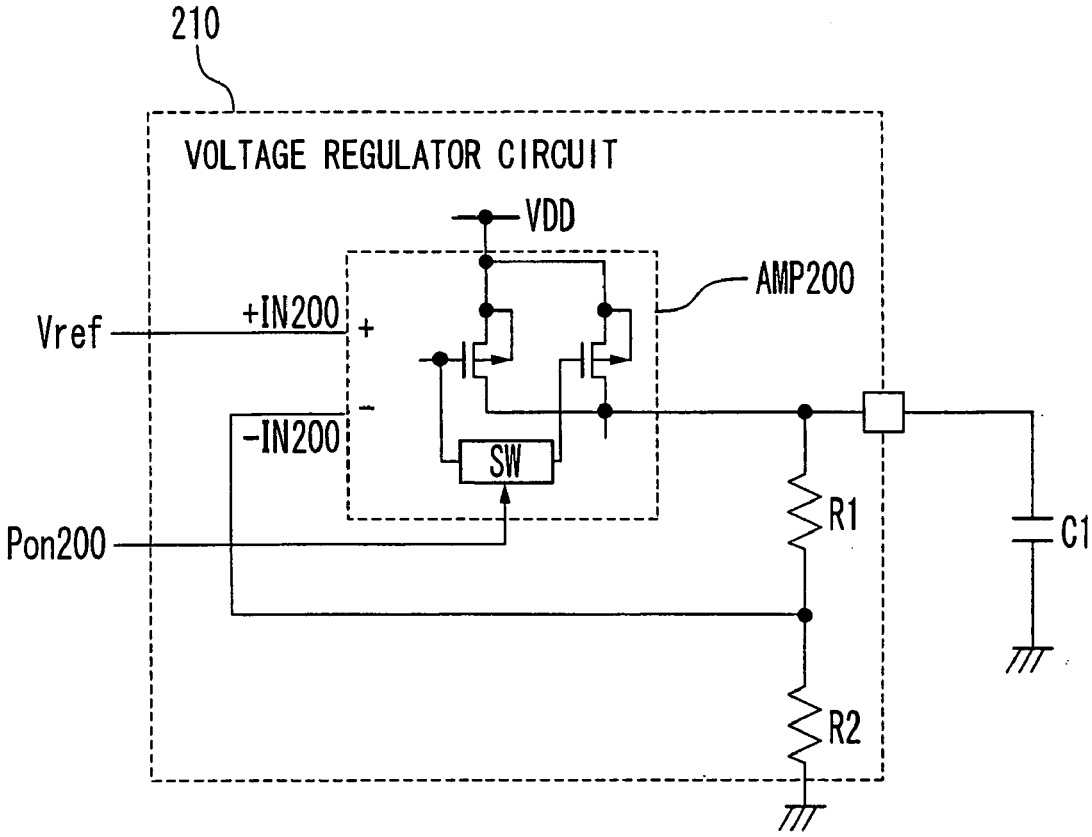
FIG. 3 is a schematic diagram showing a configuration of a circuit (voltage regulator circuit 210) described in Japanese Patent Publication No. 2005-044203A.
Figure 4:
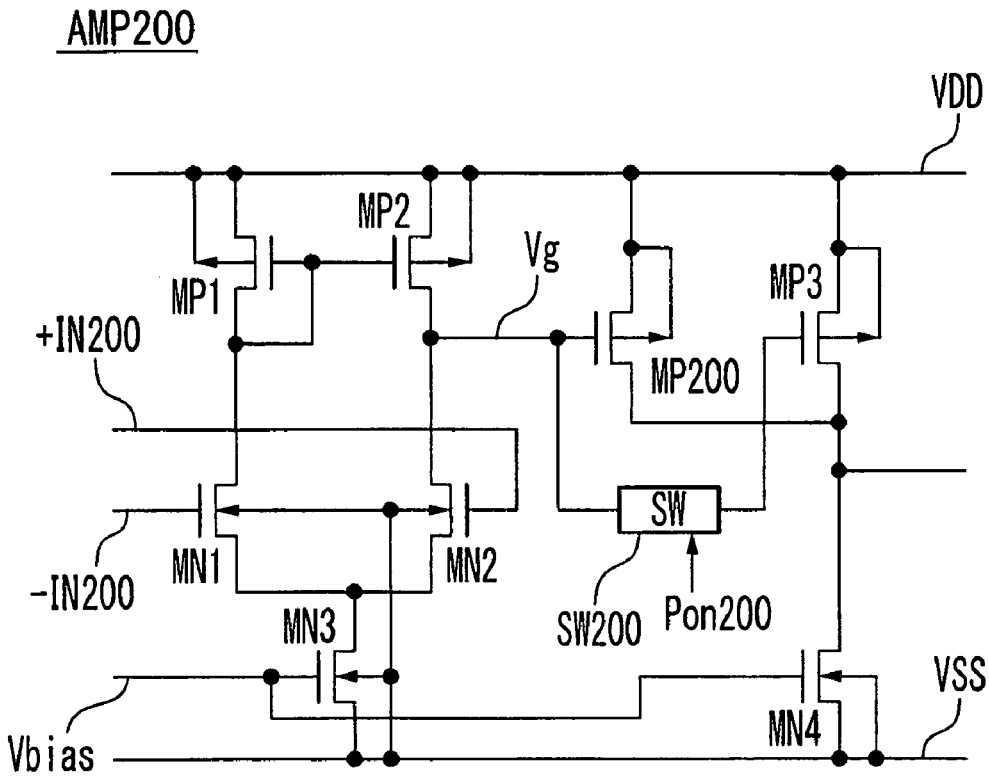
FIG. 4 is a schematic diagram showing a configuration of a differential amplifier circuit AMP200.
Figure 5:
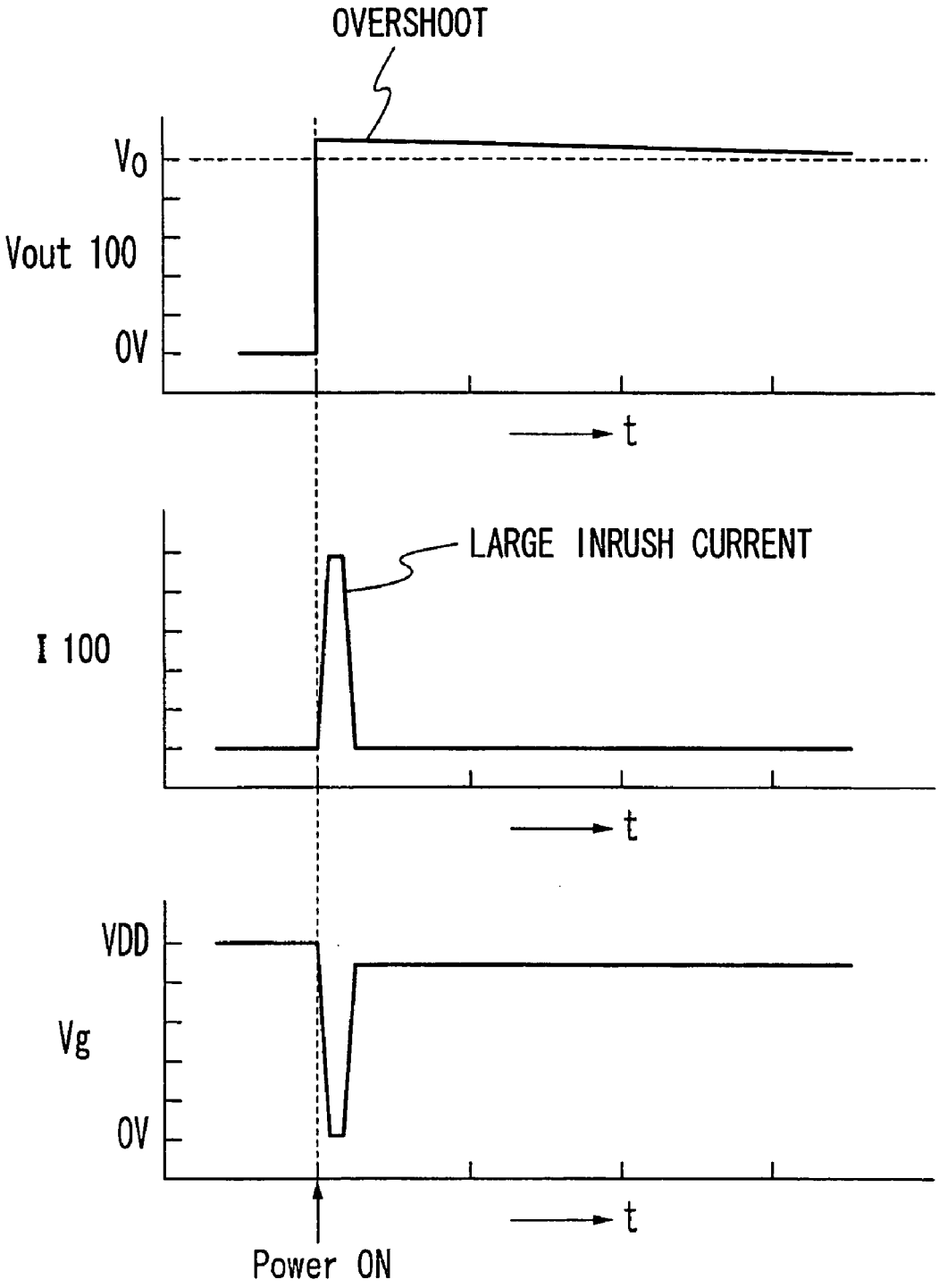
FIG. 5 is a timing chart showing an operation performed by the voltage regulator circuit 110.

The configuration of the differential amplifier circuit AM1 is the same as that shown in FIG. 1.

One end of the resistor element R1 is connected to the output terminal of the differential amplifier circuit AM1. One end of the resistor element R2 is connected to the other end of the resistor element R1, and the other end of the resistor element R2 is connected to the low-voltage power supply [VSS]. One end of the resistor element R2 is also connected to the negative-side input terminal −IN via a signal line. One end of the smoothing capacitor C1 is connected to the output terminal of the differential amplifier circuit AMP1 and to one end of the resistor element R1 via an output node. The other end of the smoothing capacitor C1 is connected to the low-voltage power supply [VSS].

The resistor elements R1 and R2 divide an output voltage Vout output from the differential amplifier circuit AMP1 into voltages to generate a divided voltage Vmon on one end of the resistor element R2. The differential amplifier circuit AMP1 amplifies a difference between the reference voltage Vref supplied to the positive-side input terminal +IN and the divided voltage Vmon supplied to the negative-side input terminal −IN. The smoothing capacitor C1 smoothes the output voltage Vout output from the differential amplifier circuit AMP1.

A common power supply starting sequence applied to a liquid crystal panel driving IC will now be described.

When the device is not turned on, the low-voltage power supply [VSS] is connected to the output of the differential amplifier circuit AMP1, that is, to an output node and the low-voltage power supply [VSS] supplies the low-voltage power supply voltage VSS (ground voltage). When the device is turned on, then the high-voltage power supply voltage VDD and the reference voltage Vref (ground voltage GND) are generated, and the output of the differential amplifier circuit AMP1 is then disconnected from the low-voltage power supply [VSS]. That is, the voltage regulator circuit 10 starts.

First, the output voltage Vout is 0 [V] and the charge of the smoothing capacitor C1 is zero the moment the voltage regulator circuit main body 10 starts. In this case, as stated above, a gate voltage Vg of a transistor MP3 (see FIG. 2) included in the differential amplifier circuit AMP1 is near 0 [V] to turn the transistor MP3 almost into an ON-state. Due to this, an ON-resistance of the transistor MP3 is very low. Next, to charge the smoothing capacitor C1, a current I flows in the smoothing capacitor C1 via the differential amplifier AMP1 from the high-voltage power supply [VDD]. However, the current I is very high as an inrush current since the ON-resistance of the transistor MP3 is very low. If the inrush current is high, such a problem possibly occurs that the overcurrent prevention circuit 33 of the stabilizing circuit 32 operates.

Furthermore, the output voltage Vout suddenly rises and exceeds the voltage-of-interest VO. A voltage amount of the output voltage Vout by as much as which the output voltage Vout exceeds the voltage-of-interest VO causes a current Isink (see FIG. 2) to flow into a transistor MN4 included in the differential amplifier circuit AMP1 from the smoothing capacitor C1. As a result, the output voltage Vout is to fall down to the voltage-of-interest VO. However, the current Isink is normally low and it takes time for the output voltage Vout to be equal to the voltage-of-interest VO, resulting in occurrence of overshoot. If overshoot occurs, then a voltage of the low voltage logic circuit 31 that uses the output of the voltage regulator circuit main body 10 as a power supply exceeds a process withstand voltage of an element, possibly causing such a defect as breakdown of the element.

Considering these, the voltage regulator circuit 30 further includes a switch control circuit 20 and first and second switches SW1 and SW2 (hereinafter, referred to as "the switches SW1 and SW2") for reducing the inrush current and the overshoot.

The switch SW1 is provided between the positive-side input terminal +IN and the negative-side input terminal −IN. Specifically, one end of the switch SW1 is connected to the positive-side input terminal +IN and the other end of the switch SW1 is connected to the negative-side input terminal −IN.

The switch SW2 is provided on a signal line connecting the negative-side input terminal −IN to one end of the resistor element R2. Specifically, one end of the switch SW2 is connected to the negative-side input terminal −IN and the other end of the switch SW2 is connected to one end of the resistor element R2.

A first control signal CTR1 (hereinafter, referred to as "the control signal CTR1") is supplied to the switch SW1 from the switch control circuit 20. If a signal level of the control signal CTR1 is High, the switch SW1 is turned on. If the signal level of the control signal CTR1 is Low, the switch SW1 is turned off.

A second control signal CTR2 (hereinafter, referred to as "the control signal CTR2") is supplied to the switch SW2 from the switch control circuit 20. If a signal level of the control signal CTR2 is High, the switch SW2 is turned on. If the signal level of the control signal CTR2 is Low, the switch SW2 is turned off. The control signal CTR2 has a signal level inverted with respect to a signal level of the control signal CTR1.

The switch control circuit 20 sets the signal level of the control signal CTR1 High and that of the control signal CTR2 Low in a period before a predetermined period passes since the device is turned on. In this case, the switch SW1 is turned on and the switch SW2 is turned off. The control signals CTR1 and CTR2 supplied during this period will be described later in detail.

At normal time (after the predetermined period), the switch control circuit 20 sets the signal level of the control circuit CTR1 Low and that of the control signal CTR2 High. In this case, the switch SW1 is turned off and the switch SW2 is turned on.

A configuration of the switch control circuit 20 will be described. The switch control circuit 20 includes a converter COMP1, a negative AND arithmetic circuit NAND1, and a NOT arithmetic circuit INV1.

The comparator COMP1 is connected to the high-voltage power supply [VDD] and the low-voltage power supply [VSS], and operates with a voltage between the high-voltage power supply voltage VDD and the low-voltage power supply voltage VSS. The comparator COMP1 includes a positive-side input terminal that is a first input terminal, a negative-side input terminal that is a second input terminal, and an output terminal. The reference voltage Vref is supplied to the positive-side input terminal of the comparator COMP1 as a supply voltage. The negative-side input terminal of the comparator COMP1 is connected to one end of the resistor element R2, and the divided voltage Vmon is supplied to the negative-side input terminal of the comparator COMP1. The comparator COMP1 compares the divided voltage Vmon with the reference voltage Vref and outputs a comparison result signal Vcomp representing a comparison result from the output terminal.

The NAND arithmetic circuit NAND1 includes a first input terminal, a second input terminal, and an output terminal. The first input terminal of the NAND arithmetic circuit NAND1 is connected to the output terminal of the comparator COMP1, and the comparison result signal Vcomp is supplied to the first input terminal of the NAND arithmetic circuit NAND1. A power-on signal Pon is supplied to the second input terminal of the NAND arithmetic circuit NAND1. A signal level of the power-on signal Pon is High until passage of predetermined time since the device is turned on. At normal time, the signal level of the power-on signal Pon is Low. The output terminal of the NAND arithmetic circuit NAND1 is connected to the switch SW2, and an output of the NAND arithmetic circuit NAND1 is supplied to the switch SW2 as the control signal CTR2.

The NOT arithmetic circuit INV1 includes an input terminal and an output terminal. The input terminal of the NOT arithmetic circuit INV1 is connected to the output terminal of the NAND arithmetic circuit NAND1. The output terminal of the NOT arithmetic circuit INV1 is connected to the switch SW1, and an output of the NOT arithmetic circuit INV1 is supplied to the switch SW1 as the control signal CTR1.

[Operation]

Figure 8:
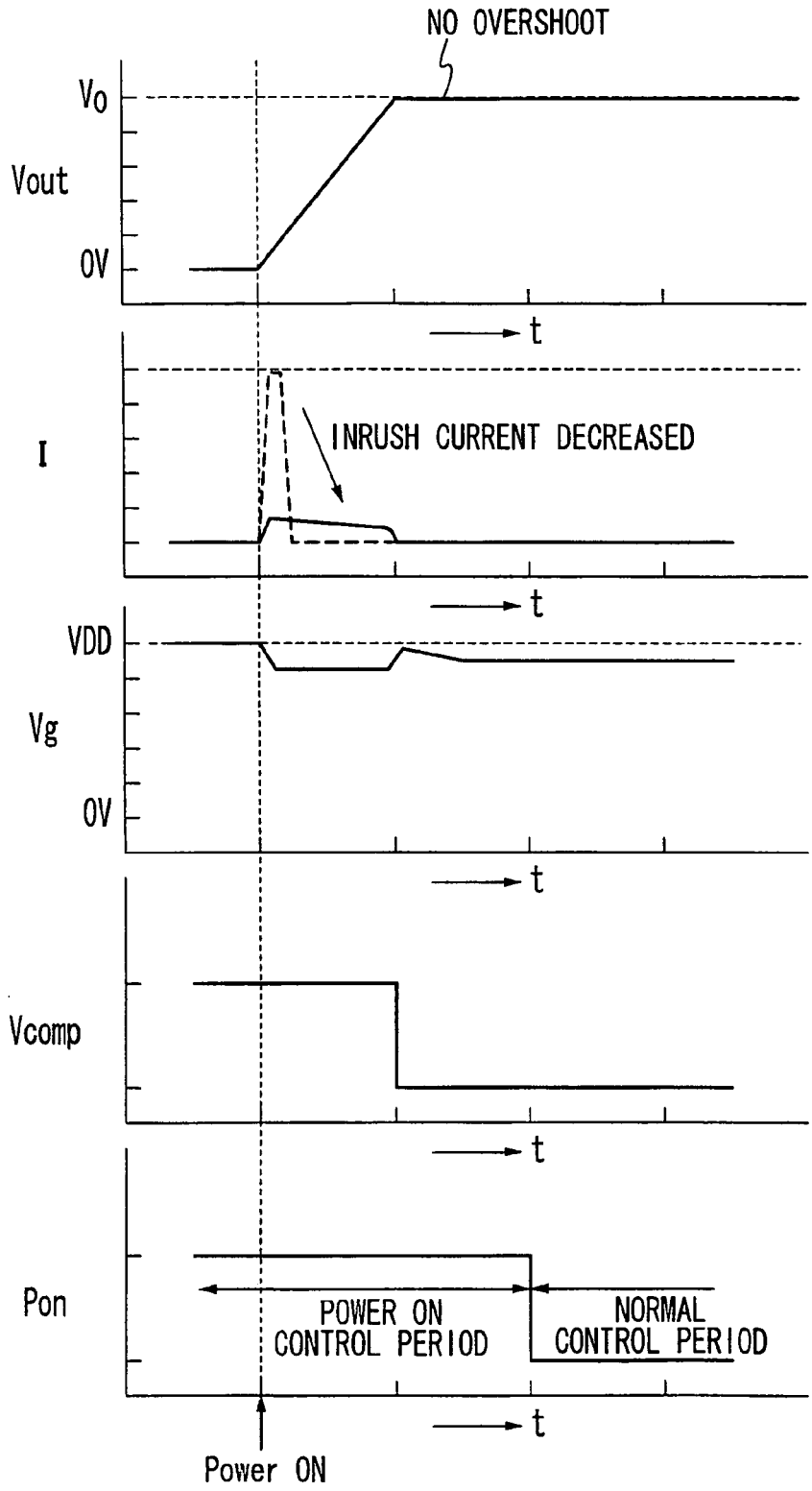
FIG. 8 is a timing chart showing operation performed by the voltage regulator circuit 30 according to an embodiment of the present invention.

FIG. 8 is a timing chart showing operation performed by the voltage regulator circuit 30.

A normal operation will first be described. At the normal time (during a normal control period shown in FIG. 8), the signal level of the power-on signal Pon is Low. In this case, a signal level of the NAND arithmetic circuit NAND is High and that of the output of the NOT arithmetic circuit INV is Low irrespectively of the output of the comparator COMP. That is, signal levels of the control signals CTR1 and CTR2 are Low and High, respectively. As a result, the switch SW1 is turned off, and the switch SW2 is turned on according to the control signal CTR2 (High). At this time, the negative-side input terminal −IN of the differential amplifier circuit AMP1 is connected to one end of the resistor element R2. At the normal time, the voltage regulator circuit main body 10 is similar in a state to the voltage regulator circuit 110 and the output voltage Vout output from the differential amplifier circuit AMP1 is controlled to be constant to the voltage-of-interest VO.

Operation performed by the voltage regulator 30 when the device is turned on will be described.

When the device is not turned on, the low-voltage power supply voltage VSS (ground voltage GND) is supplied to the output of the differential amplifier circuit AMP1. When the device is turned on (Power ON in FIG. 8), then the high-voltage power supply voltage VDD and the reference voltage Vref are generated, and supply of the low-voltage power supply voltage VSS to the output of the differential amplifier circuit AMP1 is stopped. In addition, until passage of the predetermined time since the device is turned on (power-ON control period in FIG. 8), the signal level of the power-ON signal Pon is High.

Right after the device is turned on (Power ON in FIG. 8), the output voltage Vout is 0 [V] and the charge of the smoothing capacitor C1 is zero. In this case, the divided voltage Vmon obtained by causing the resistor elements R1 and R2 divide the output voltage Vout is also 0 [V]. At this time, the reference voltage Vref is higher than the divided voltage Vmon. That is, the reference voltage Vref and the divided voltage satisfy Vmon Vref>Vmon. Due to this, the signal level of the comparison result signal Vcomp output from the comparator COMP1 is High.

As stated above, the signal level of the power-ON signal Pon is High. In this case, the signal level of the output of the NAND arithmetic circuit NAND is Low and that of the output of the NOT arithmetic circuit INV is High. That is, the signal levels of the control signals CTR1 and CTR2 are High and Low, respectively. As a result, the switch SW1 is turned on according to the control signal CTR1 (High), and the switch SW2 is turned off. At this time, the negative-side input terminal −IN of the differential amplifier circuit AMP1 is connected to the positive-side input terminal +IN thereof. Accordingly, the reference voltage Vref is supplied, as a same voltage, to the positive-side input terminal +IN and the negative-side input terminal −IN of the differential amplifier circuit AMP1.

The operation performed by the switch control circuit 20 for outputting the control signal CTR1 (High) when the reference voltage Vref is higher than the divided voltage Vmon during the predetermined period will be referred to as "the first operation".

Next, during the predetermined period, the voltage supplied to the positive-side input terminal +IN of the differential amplifier circuit AMP1 is equal to that supplied to the negative-side input terminal −IN thereof. At this time, a gate voltage Vg of the transistor MP3 (see FIG. 2) included in the differential amplifier circuit AMP1 is near a threshold voltage Vt. Due to this, an ON-resistance of the transistor MP3 is relatively high. Next, to charge the smoothing capacitor C1, the current I flows in the smoothing capacitor C1 via the differential amplifier circuit AMP1 from the high-voltage power supply [VDD]. However, a current value of the current I is limited to low because of the high ON-resistance of the transistor MP3, so that the output voltage Vout output from the differential amplifier circuit AMP1 gradually rises.

Next, during the predetermined period, the output voltage Vout exceeds the voltage-of-interest VO. At this time, the divided voltage Vmon divided by the resistor elements R1 and R2 exceeds the reference voltage Vref. In this case, because of Vref<Vmon, the signal level of the comparison result signal Vcomp output from the comparator COMP1 is inverted to Low. Since the signal level of the power-ON signal Pon is High, the signal level of the NAND arithmetic circuit NAND1 is High and that of the output of NOT arithmetic circuit INV1 is Low. That is, the signal levels of the control signals CTR1 and CTR2 are Low and High, respectively. As a result, the switch SW1 is turned off, and the switch SW2 is turned on according to the control signal CTR2 (High). At this time, the negative-side input terminal −IN of the differential amplifier circuit AMP1 is connected to one end of the resistor element R2.

Operation performed by the switch control circuit 20 for outputting the control signal CTR2 (High) if the divided voltage Vmon is higher than the reference voltage Vref during the predetermined period will be referred to as "the second operation".

Next, during the predetermined period, the output voltage Vout is controlled to be constant. If the output voltage Vout falls to be lower than the reference voltage Vref, that is, Vref>Vmon, then the switch SW1 is turned on according to the control signal CTR1 (High), the switch SW2 is turned off, and the output voltage Vout rises. That is, the switch control circuit 20 re-executes the first operation. The switch control circuit 20 alternately executes the first and second operations until the output voltage Vout is made equal to the voltage-of-interest VO.

After passage of the predetermined time, the signal level of the power-ON signal Pon is Low and the voltage regulator circuit 30 executes normal operation. That is, at the normal time, the voltage regulator circuit main body 10 is similar in state to the voltage regulator circuit 110 and the output voltage Vout is controlled to be constant to the voltage-of-interest VO.

In the voltage regulator circuit 30 according to this embodiment of the present invention, if the voltage regulator circuit 30 is turned on, then the switch SW1 is turned on according to the control signal CTR1 (High), the switch SW2 is turned off, and the reference voltage Vref is supplied, as the same voltage, to the positive-side input terminal +IN and the negative-side input terminal −IN of the differential amplifier circuit AMP1. If the voltage supplied to the positive-side input terminal +IN of the differential amplifier circuit AMP1 is equal to that supplied to the negative-side input terminal −IN thereof, the current value of the current I flowing from the high-voltage power supply [VDD] to the smoothing capacitor C1 via the differential amplifier circuit AMP1 is limited to low. Specifically, if the voltage supplied to the positive-side input terminal +IN of the differential amplifier circuit AMP1 is equal to that supplied to the negative-side input terminal −IN thereof, the gate voltage Vg of the transistor MP3 (see FIG. 2) included in the differential amplifier circuit AMP1 is near the threshold voltage Vt. Due to this, the ON-resistance of the transistor MP3 is relatively high. To charge the smoothing capacitor C1, the current I flows in the smoothing capacitor C1 via the differential amplifier circuit AMP1 from the high-voltage power supply [VDD]. However, the current value of the current I is limited to low because of the high ON-resistance of the transistor MP3. That is, the inrush current can be reduced. Furthermore, the voltage regulator circuit 30 according to this embodiment of the present invention can reduce the overshoot because of gradual rise of the output voltage Vout output from the differential amplifier circuit AMP1.

Although the present invention has been described above in connection with several exemplary embodiments thereof, it would be apparent to those skilled in the art that those exemplary embodiments are provided solely for illustrating the present invention, and should not be relied upon to construe the appended claims in a limiting sense.

What is claimed is:

1. A voltage regulator circuit comprising:

a differential amplifier circuit, a reference voltage is supplied to a first input of the differential amplifier circuit, and a smoothing capacitor is connected to an output of the differential amplifier circuit;

a first resistor element whose one end is connected to the output of the differential amplifier circuit;

a second resistor element whose one end is connected to another end of the first resistor element;

a first switch, one end of the first switch is connected to the first input of the differential amplifier circuit, another end of the first switch is connected to a second input of the differential amplifier circuit, and the first switch is configured to be turned on in response to a first control signal;

a second switch, an end of the second switch is connected to the second input of the differential amplifier circuit, another end of the second switch is connected to the second resistor element, and the second switch is turned on in response to a second control signal; and a switch control circuit configured to output the first control signal in a predetermined period from a power supply is turned on, and to output the second control signal after the predetermined period.

2. The voltage regulator circuit according to claim 1, wherein an output voltage output from the differential amplifier circuit is divided by the first and second resistor elements to generate a divided voltage at the one end of the second resistor element;

the differential amplifier circuit is configured to amplify a difference between the reference voltage input to the first input and the divided voltage input to the second input to output as the output voltage; and the switch control circuit is configured to, in the predetermined period, operate:

performing a first operation by which the first control signal is output when the reference voltage is higher than the divided voltage; and performing a second operation by which the second control signal is output when the divided voltage is higher than the reference voltage, and the first operation and the second operation are alternately performed until the output voltage reaches to a voltage-of-interest.

3. The voltage regulator circuit according to claim 2, wherein the switch control circuit comprises:

a comparator, the reference voltage is input to a first input of the comparator, a second input of the comparator is connected to the one end of the second resistor element, and configured to generate an output of a comparison result signal representing a result of a comparison between the reference voltage and the divided voltage;

a negative AND arithmetic circuit, a first input of the negative AND arithmetic circuit is connected to the output of the comparator, an output of the negative AND arithmetic circuit is connected to the second switch, wherein a power-on signal is supplied to a second input of the negative AND arithmetic circuit until the predetermined period from a power supply is turned on; and a NOT arithmetic circuit, an input of the NOT arithmetic circuit is connected to an output of the negative AND arithmetic circuit, and an output of the NOT arithmetic circuit is connected to the first switch, wherein in the predetermined period, a signal level of the comparison result signal is a first level when the reference voltage is higher than the divided voltage, and is a second level being an inverted level of the first level when the divided voltage is higher than the reference voltage, supposing that the first switch is turned on when a signal level of the first control signal is the first level and is turned off when a signal level of the first control signal is the second level, and the second switch is turned on when a signal level of the second control signal is the first level and is turned off when a signal level of the second control signal is the second level.

4. The voltage regulator circuit according to claim 1, wherein the differential amplifier circuit is configured to operate with a voltage between a high-voltage power supply voltage and a low-voltage power supply voltage being lower than the high-voltage power supply voltage, and the low-voltage power supply voltage is supplied to the another end of the second resistor element.

5. The voltage regulator circuit according to claim 4, wherein the low-voltage power supply voltage is supplied to the output of the differential amplifier circuit when a power supply is not turned on, and the high-voltage power supply voltage and the reference voltage are generated and subsequently a supply of the low-voltage power supply voltage to the output of the differential amplifier circuit is released when the power supply is turned on.

6. The voltage regulator circuit according to claim 4, wherein the differential amplifier circuit comprises:

a first N-channel MOS (Metal Oxide Semiconductor) transistor and a second N-channel MOS transistor whose respective sources are connected to a common node, wherein a gate of the first N-channel MOS transistor is used as the second input of the differential amplifier circuit, and a gate of the second N-channel MOS transistor is used as the first input of the differential amplifier circuit;

a first constant current source arranged between the sources of the first and second N-channel MOS transistors and a low-voltage power source configured to supply the low-voltage power supply voltage;

a first P-channel MOS transistor and a second P-channel MOS transistor whose respective sources are connected to a high-voltage power supply configured to supply the high-voltage power supply voltage, whose respective gates are connected to a common node, drains of the first and second P-channel MOS transistors are respectively connected to drains of the first and second N-channel MOS transistors, and the gate of the first P-channel MOS transistor is connected to the drain of the first N-channel MOS transistor;

a third P-channel MOS transistor, a source of the third P-channel MOS transistor is connected to the high-voltage power supply, a gate of the third P-channel MOS transistor is connected to the drain of the second N-channel MOS transistor, and a drain of the third P-channel MOS transistor is connected to the one end of the first resistor element; and a second constant current source arranged between the drain of the third P-channel MOS transistor and the low-voltage power supply.

7. An apparatus comprising:

a low-voltage logic circuit configured to operate with a voltage-of-interest being a first voltage;

a power supply section configured to supply a power-supply voltage being a second voltage higher than the voltage-of-interest;

a stabilization circuit configured to stabilize the power supply voltage to supply as a supply voltage; and the voltage regulator circuit according to claim 1, an output of the voltage regulator circuit is connected to a smoothing capacitor, configured to input the supply voltage from the stabilization circuit as the reference voltage, to regulate the input reference voltage to an appropriate voltage being the voltage-of-interest, and to supply the voltage-of-interest to the low-voltage logic circuit.

8. The apparatus according to claim 7, wherein the stabilization circuit comprises an overcurrent prevention circuit for preventing an overcurrent.

9. An operation control method of a voltage regulator circuit, wherein the voltage regulator circuit comprises:

a differential amplifier circuit, a reference voltage is supplied to a first input of the differential amplifier, and an output of the differential amplifier circuit is connected to a smoothing capacitor;

a first resistor element whose first end is connected to the output of the differential amplifier circuit;

a second resistor element whose one end is connected to another end of the first resistor element, and the operation control method comprises:

connecting a first input and a second input of the differential amplifier circuit to each other in a predetermined period from a power supply is turned on; and connecting the second input of the differential amplifier circuit and the one end of the second resistor element.

10. An operation control method of the voltage regulator circuit according to claim 9, wherein an output voltage output from the differential amplifier circuit is divided by the first and second resistor elements, and the differential amplifier circuit is configured to amplify a difference between a reference voltage supplied to the first input of the differential amplifier circuit the divided voltage supplied to the second input of the differential amplifier circuit, wherein the connecting the first input and the second input of the differential amplifier circuit comprises:

performing a first operation by which the first and the second inputs of the differential amplifier circuit are connected to each other when the reference voltage is higher than the divided voltage in the predetermined period, and the operation control method of the voltage regulator circuit further comprises, in the predetermined period, performing:

performing a second operation by which the second input of the differential amplifier circuit and the one end of the second resistor element are connected to each other when the divided voltage is higher than the reference voltage; and alternately performing the first operation and the second operation until the output voltage reaches to a voltage-of-interest.

* * * * *